US011646520B2

(12) United States Patent
Bock et al.

(10) Patent No.: US 11,646,520 B2
(45) Date of Patent: May 9, 2023

(54) CONTACT DEVICE FOR RECEIVING A PLUG END WITH CONTACTS HAVING DIFFERENT COUPLING END DISTANCES

(71) Applicant: MD ELEKTRONIK GmbH, Waldkraiburg (DE)

(72) Inventors: Daniel Bock, Schoenberg (DE); Dominik Schroll, Ampfing (DE); Thomas Grasser, Gars am Inn (DE); Thomas Halbig, Dietfurt (DE)

(73) Assignee: MD ELEKTRONIK GMBH, Waldkraiburg (DE)

( * ) Notice: Subject to any disclaimer, the term of this patent is extended or adjusted under 35 U.S.C. 154(b) by 35 days.

(21) Appl. No.: 17/371,117

(22) Filed: Jul. 9, 2021

(65) Prior Publication Data

US 2022/0029331 A1 Jan. 27, 2022

(30) Foreign Application Priority Data

Jul. 22, 2020 (DE) ..... 10 2020 119 282.7

(51) Int. Cl.

| | |
|---|---|
| ***H01R 13/04*** | (2006.01) |
| *H01R 12/58* | (2011.01) |
| *H01R 12/70* | (2011.01) |
| *H01R 13/405* | (2006.01) |
| *H01R 13/6464* | (2011.01) |
| *H01R 13/6581* | (2011.01) |

(52) U.S. Cl.

CPC ..... *H01R 13/04* (2013.01); *H01R 12/58* (2013.01); *H01R 12/707* (2013.01); *H01R 13/405* (2013.01); *H01R 13/6464* (2013.01); *H01R 13/6581* (2013.01)

(58) Field of Classification Search

CPC ..... H01R 12/58; H01R 12/707; H01R 13/04; H01R 13/405; H01R 13/6464; H01R 13/6581

USPC ..... 439/607.01

See application file for complete search history.

(56) References Cited

U.S. PATENT DOCUMENTS

| | | | | |
|---|---|---|---|---|
| 6,183,302 | B1 * | 2/2001 | Daikuhara | H01R 24/44 439/607.1 |
| 6,361,367 | B1 * | 3/2002 | Daikuhara | H01R 24/44 439/108 |
| 6,371,812 | B1 * | 4/2002 | Daikuhara | H01R 24/44 439/607.09 |

(Continued)

FOREIGN PATENT DOCUMENTS

| | | | |
|---|---|---|---|
| CN | 201142392 | Y * | 10/2008 |
| EP | 2184810 | A1 | 5/2010 |

*Primary Examiner* — Peter G Leigh

(74) *Attorney, Agent, or Firm* — Leydig, Voit & Mayer, Ltd.

(57) ABSTRACT

A contact device for receiving a plug end includes a first contact, which has a first coupling end and a first contact end, and a second contact, which has a second coupling end and a second contact end. The coupling ends are configured to electrically couple the respective contact to a receiving device, and the contact ends are configured to electrically connect the respective contact to a contact element of the plug end. The shortest distance between the first coupling end and the first contact end is not equal to the shortest distance between the second coupling end and the second contact end. The total length of the first contact is equal to, or is within a predetermined tolerance from, the total length of the second contact.

16 Claims, 8 Drawing Sheets

(56) References Cited

U.S. PATENT DOCUMENTS

| | | | | |
|---|---|---|---|---|
| 7,806,704 | B2 * | 10/2010 | Miyoshi | H01R 13/6474 439/108 |
| 9,548,569 | B2 * | 1/2017 | Tanaka | H01R 24/68 |
| 9,705,219 | B2 * | 7/2017 | Yamakami | H01R 12/724 |
| 2009/0269980 | A1 * | 10/2009 | Gong | H01R 27/02 439/638 |
| 2011/0151722 | A1 * | 6/2011 | Kobayashi | H01R 13/6594 439/660 |
| 2014/0011405 | A1 | 1/2014 | Tai et al. | |
| 2016/0126658 | A1 | 5/2016 | Yamakami et al. | |
| 2016/0276780 | A1 | 9/2016 | Tanaka et al. | |
| 2020/0212636 | A1 | 7/2020 | Chang et al. | |

* cited by examiner

CONTACT DEVICE FOR RECEIVING A PLUG END WITH CONTACTS HAVING DIFFERENT COUPLING END DISTANCES

CROSS REFERENCE TO RELATED APPLICATIONS

This application claims benefit to German Patent Application No. DE 10 2020 119 282.7, filed on Jul. 22, 2020, which is hereby incorporated by reference herein.

FIELD

The invention relates to a contact device for receiving a plug end.

The present invention is mainly described in conjunction with conductors and plugs for symmetric data transmission. However, it is understood that the present invention can be used in all applications in which multiple conductors are to be contacted via a plug or a plug receptacle or socket.

BACKGROUND

In modern applications of data processing, the data quantities to be transmitted in a system are continuously increasing. For example, functions for partially autonomous or fully autonomous driving of a vehicle are implemented in vehicles, for which functions a plurality of sensor data and control data must be transmitted.

For connecting the individual components of such a system, i.e., for example, the control devices, sensors and actuators, a plurality of cables, plugs and corresponding sockets or plug receptacles are required. Symmetric data transmission systems are frequently used in such systems due to the positive properties for data transmission, in particular the high degree of immunity against external interfering influences. Such symmetric data transmission systems use so-called twisted pair cables, for example, in which pairs of conductors twisted together are used for data transmission.

In order to ensure the quality of the data transmission, in particular at high transmission frequencies, the characteristic impedance of the push-pull mode should be constant over the conductor length in such systems. Furthermore, for any conductor section, the self-inductance of the individual conductors of a pair of conductors and the capacitance to the conductive housing should be the same. Data transmission paths for the individual conductors of a pair of conductors should be the same length if at all possible. Furthermore, the capacitances on the conductor path should be as constant as possible.

At the connection points at which such a twisted pair cable is connected to a device, for example a vehicle control device, corresponding plug receptacles or sockets, in which the contacts are guided in the same length and next to one another in parallel to one another, are therefore used. In this manner, it can be ensured for such a plug receptacle or socket that the data transmission paths are of the same length and the capacitances are constant.

Since the individual contacts are arranged next to one another in such a plug receptacle or socket, such a plug receptacle or socket requires a corresponding installation space, for example on a carrier circuit board.

SUMMARY

In an embodiment, the present disclosure provides a contact device for receiving a plug end. The contact device includes a first contact, which has a first coupling end and a first contact end, and a second contact, which has a second coupling end and a second contact end. The coupling ends are configured to electrically couple the respective contact to a receiving device, and the contact ends are configured to electrically connect the respective contact to a contact element of the plug end. The shortest distance between the first coupling end and the first contact end is not equal to the shortest distance between the second coupling end and the second contact end. The total length of the first contact is equal to, or is within a predetermined tolerance from, the total length of the second contact.

BRIEF DESCRIPTION OF THE DRAWINGS

Subject matter of the present disclosure will be described in even greater detail below based on the exemplary figures. The figures are merely schematic representations and serve only to explain embodiments of the invention. Identical or identically acting elements are continuously provided with the same reference signs. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
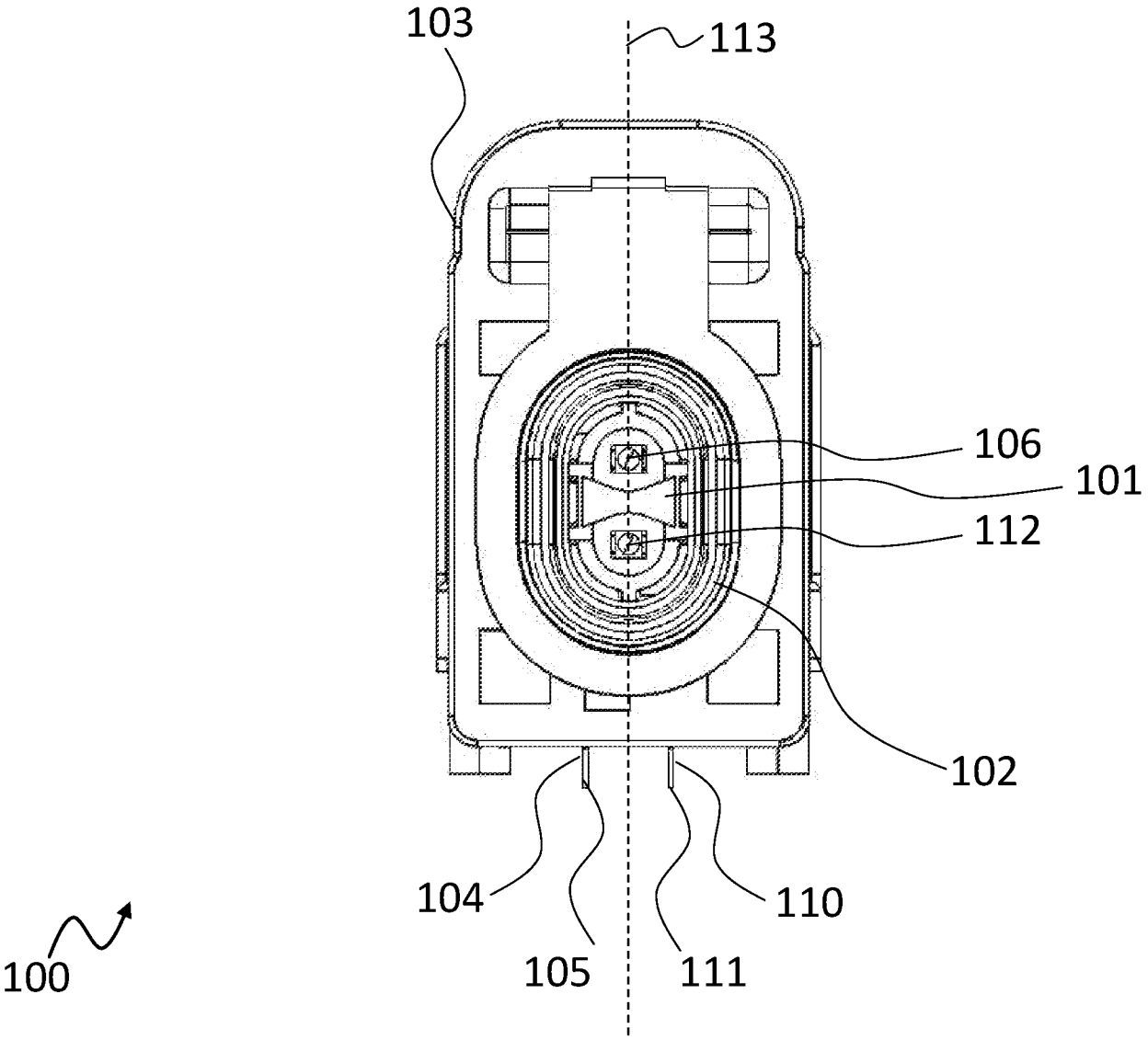
FIG. 1 a front view of an exemplary embodiment of a contact device according to the present invention.

Embodiments of the present invention provide to reduce the installation space requirement for receiving plugs on a device.

A contact device according to an embodiment of the present invention for receiving a plug end has: a first contact having a first coupling end and a first contact end, and a second contact having a second coupling end and a second contact end, wherein the coupling ends are formed to electrically couple the respective contact to a receiving device, i.e., for example, a carrier circuit board, and wherein the contact ends are formed to electrically connect the respective contact to a contact element of the plug end, wherein the shortest distance between the first coupling end and the first contact end is not equal to the shortest distance between the second coupling end and the second contact end, and wherein the total length of the first contact is equal to the total length of the second contact, or the difference is within a predetermined tolerance value. It is particularly preferred that the contact lengths of the first and second contacts are selected such that, in the event of a galvanic connection of the first and second contacts to the receiving device and the respective contact elements of the plug end, a path that a direct current travels from the receiving device via the first contact to the respective contact element of the plug end has the same length as a path that a direct current travels from the receiving device via the second contact to the respective contact element of the plug end.

An embodiment of the present invention is based on the finding that contacts arranged next to one another in a plug receptacle or socket lead to an increased installation space requirement in the horizontal direction. However, the installation space is usually limited precisely in the horizontal direction, i.e., in the plane in which the receiving device, i.e., for example, a carrier circuit board, lies. In the vertical direction, on the other hand, i.e., from the carrier circuit board upward, there is usually sufficient installation space available, for example because other components that are higher than the plug receptacle or socket are arranged on the circuit board.

In this context, the term "plug end" is to be understood as the part of an electrical plug that is inserted into a plug receptacle or socket. The contact device according to the present invention can form such a plug receptacle or socket. The contact device can in particular serve to receive plugs of twisted-pair or parallel-pair conductors.

In order to reduce the installation space requirement of the plug receptacles or sockets, in particular in the horizontal direction or the plane of the carrier circuit board, in an electrical device, the present invention provides the contact device.

The contact device serves to receive a plug end of an electrical plug and to electrically contact the individual electrical contacts in the plug end. The contact device can therefore also be referred to as a socket or (plug) receptacle.

A first contact and a second contact are provided in the contact device. It is understood that further contacts may be provided. The explanations and the claimed features regarding the first contact and the second contact apply analogously to such further contacts. For example, in one embodiment, a contact device can be provided with three or four contacts.

Furthermore, it is understood that a plurality of contact devices may be combined in a housing. For example, two or more contact devices may be arranged horizontally next to one another in a common housing, i.e., on the contact ends in a front view. Within the framework of the present invention, the terms "next to one another" or "horizontally" are to be understood as next to one another relative to the plane in which the receiving device lies, unless otherwise defined. Accordingly, the terms "one above the other" or "vertically" are to be understood as one above the other relative to the plane in which the receiving device lies, unless otherwise defined.

Each of the contacts serves for electrically contacting an electrical contact of the plug end and for coupling to a receiving device that receives the contact device. For this purpose, each of the contacts provides a coupling end and a contact end.

Each of the coupling ends serves for contacting the receiving device and can be soldered, for example, to a conductor track on a carrier circuit board. The contact end serves to establish the electrical contact with the corresponding electrical contact in the plug end. The contact ends may be formed, for example, as so-called contact pins. Alternatively, the contact ends may also be formed as so-called spring contacts, into which a contact pin can be inserted. It is understood that any shape of the contact ends that enables a corresponding electrical contacting is possible.

The contact device offers the possibility of shaping the first contact geometrically differently than the second contact. In particular with regard to the positions of the contact ends and the coupling ends.

According to an embodiment of the present invention, the shortest distance between the first coupling end and the first contact end is not equal to the shortest distance between the second coupling end and the second contact end. The coupling ends and the contact ends of the contacts may be elongated. The distance can therefore be defined, for example, starting from the ends of the coupling ends and contact ends.

With conventional plugs for twisted-pair conductors, identical contacts are situated in parallel next to one another. Such conventional contacts consequently have identical shortest distances between the contact ends and the coupling ends.

By means of the contacts of the present invention, the contact ends may be arranged one above the other starting from a carrier circuit board. On the other hand, the coupling ends may, for example, be arranged next to one another on the circuit board. At the same time, the present invention provides that the first contact and the second contact have the same total length.

The contacts may be elongated and have a shape deviating from a straight shape. The contacts may consequently be correspondingly kinked or bent at least in sections. In particular, in one embodiment, the coupling ends and contact ends may have a straight or approximately straight shape and may be elongated. The contacts may be formed, for example, as stamped and bent parts or as bent wire pieces.

The present invention makes it possible to design the contact device to be very narrow with a vertical arrangement of the two contact ends one above the other. Consequently, more contact devices may be arranged over the same width of, for example, a circuit board than with conventional plug receptacles.

At the same time, by the contacts having the same total length, it is ensured that the signals on both conductor paths have the same propagation time.

The definition of the unequal shortest distance between the first coupling end and the first contact end as well as between the second coupling end and the second contact end enables a highly flexible design of the two contacts and results in the two contacts having different geometries.

In particular, the contact ends may also be formed to be tilted from the vertical plane, for example, i.e., in a front view of the contact ends, they may have a certain lateral offset from one another. Furthermore, it is possible to position the coupling ends on the receiving device in a highly flexible manner. In this case, only the same total length of the contacts must be ensured. In this case, it can also be provided in particular that the total length of the first contact is equal to the total length of the second contact or the difference is within a predetermined tolerance value. This tolerance value can be selected, for example, as a function of the frequency of the signals to be transmitted and thus as a function of the wavelength of these signals such that error-free data transmission is ensured or predetermined limit values are met by the respective transmission system. The tolerance value can be, for example, between 2 mm and 0 mm, in particular between 1 mm and 0 mm, in particular also between 0.5 mm and 0 mm or 0.2 mm and 0 mm, in particular also between 0.1 mm and 0 mm or 0.05 mm and 0 mm.

Further embodiments and developments result from the description with reference to the figures.

In one embodiment, the shortest distance between the first contact and the second contact can vary over the entire length of extent of the contacts at most by a predetermined limit value.

As already explained above, the first contact and the second contact may have different geometries. In particular, the contacts may be twisted together such that the distance between the contacts is approximately constant over their entire length. In this case, the distance is to be regarded in each case as the shortest distance between the two contacts at any point over their entire length of extent.

The limit value can be defined, for example, as an absolute value, i.e., for example, as a value in millimeters. Alternatively, the limit value can also be defined as a relative value, i.e., for example, as a percentage of the greatest or smallest distance present. For example, the limit value can be 1 mm, 0.5 mm or 0.25 mm. alternatively, the limit value can be 20%, 10% or 5%.

The limit value results in the two contacts running at least approximately at the same distance. Smaller variations in the distance may also be included in the limit value. This makes it possible to adjust the capacitance between the first conductor and the second conductor and to keep it almost constant. This ensures the quality of the signal transmission.

In another embodiment, a direction of longitudinal extent of the first coupling end can be formed to be parallel to a direction of longitudinal extent of the second coupling end. Furthermore, a direction of longitudinal extent of the first contact end can be formed to be parallel to a direction of longitudinal extent of the second contact end.

As already explained above, the coupling ends and the contact ends may be formed to be almost straight. In the contact device, the first coupling end and the second coupling end may then be oriented at least approximately in parallel to one another, which ensures that their directions of longitudinal extent are parallel. The same also applies to the first coupling end and the second coupling end.

The contact ends may consequently be arranged as a pair with a defined distance and a defined orientation. The same also applies to the coupling ends.

In yet another embodiment, the direction of longitudinal extent of the first coupling end can be arranged at a first predetermined angle to the direction of longitudinal extent of the first contact end. Additionally or alternatively, the direction of longitudinal extent of the second coupling end can be arranged at a second predetermined angle to the direction of longitudinal extent of the second contact end. In this case, in particular, the first predetermined angle can correspond to the second predetermined angle.

The first predetermined angle and the second predetermined angle may, for example, be defined in each case for a projection of the coupling ends or the contact ends into a predetermined plane. This predetermined plane can be defined, for example, by the connecting line between the end of the first contact end and the end of the second contact end and the longitudinal axis or direction of longitudinal extent of the first contact end or of the second contact end.

The predetermined angles may be approximately 90°, for example. In such a design, the coupling ends may, for example, be guided perpendicularly through a printed circuit board, while the contact ends may be parallel to the plane of the printed circuit board.

In another embodiment, a connecting line between the first coupling end and the second coupling end can be arranged at a third predetermined angle, in particular an angle of 60° to 120°, or of 70° and 110°, or of 80° to 100°, or of 85° to 95°, or an angle of 90°, to a plane. In this case, the plane can lie in the direction of longitudinal extent of the first contact end and the direction of longitudinal extent of the second contact end.

The connecting line can thus lie, for example, perpendicularly on the plane through the direction of longitudinal extent of the first contact end and the direction of longitudinal extent of the second contact end. In general, in one embodiment, the connecting line can lie, for example, in a plane that is arranged at a predetermined angle, i.e., for example, a 90° angle, to the plane through the direction of longitudinal extent of the first contact end and the direction of longitudinal extent of the second contact end. Such a plane can thus be, for example, the plane in which a carrier circuit board for the contact device lies.

With conventional plug sockets, for example, identical contacts with a 90° bend are next to one another. The contact ends consequently lie in a plane parallel to the plane of the carrier circuit board and occupy a large installation space in the horizontal direction.

In contrast, in the contact device according to the present invention, the contact ends may be arranged vertically one above the other, for example, above the plane in which, for example, a carrier circuit board lies. At the same time, however, the coupling ends may be arranged next to one another, for example, in the plane in which the carrier circuit board lies. For this purpose, it is necessary to provide the contacts according to the present invention with different geometries instead of the identical conventional contacts.

If the coupling ends on the carrier circuit board lie on a straight line that is parallel to the connections of a receiver module (or a transmitter module), a length compensation on the carrier circuit board due to different distances between the coupling ends and the respective receiver module can be dispensed with. Thus, the layout of the circuit on the carrier circuit board is considerably simplified.

In yet another embodiment, a connecting line between the first contact end and the second contact end can be at a predetermined angle, in particular an angle of −30° to 30°, or an angle of −10° to 10°, or an angle of −5° to 5°, or an angle of 0°, to the direction of longitudinal extent of the first coupling end or the direction of longitudinal extent of the second coupling end.

The predetermined angle can, for example, be defined in each case for a projection of the connecting line onto a plane through the direction of longitudinal extent of the first coupling end and the direction of longitudinal extent of the second coupling end.

If the contact ends are fixed in a carrier circuit board, they usually project orthogonally through the carrier circuit board. In the case of an angle of 0° of the connecting line between the first contact end and the second contact end, the contact ends are consequently perpendicularly one above the other above the carrier circuit board.

The vertical arrangement of the contact ends leads to a substantially lower installation space requirement of the contact device in the horizontal direction relative to, for example, a carrier circuit board on which the contact device is arranged.

In one embodiment, however, the predetermined angle can also deviate from 0° and the contact ends consequently lie obliquely one above the other above the carrier circuit board.

In yet another embodiment, the first contact and/or the second contact between the first coupling end and the first contact end can have a length compensation section, which can in particular be formed to be meandering.

The length compensation section serves to extend to the predetermined length the contact that would be the shorter contact without the length compensation section.

Conductors of different lengths lead to a phase shift at the conductor end during differential signal transmission. The signal consequently receives a common mode component, which results from the superposition of the phase-shifted individual signals. Such a common mode component leads to so-called mode conversion. The resulting common mode can cause an emission and thus a signal disturbance. Furthermore, excessively large phase shifts between the two signals may lead to errors in signal reception in the respective receiver module. Merely as an example, it should be noted here that PCIe data conductors for a data transmission rate of 2.5 Gbit/s require maximum differences in length of 0.1 mm.

It is consequently in particular advantageous for high data transmission rates to provide a length compensation section. Such a length compensation section results in greater design freedom in the geometries of the individual contacts. In a first step, the contacts may be designed without regard to the resulting conductor length. The differences in length may subsequently be corrected with the aid of the length compensation section.

In particular, in an embodiment in which the contacts must be guided with an approximately constant distance from one another, the greater design freedom for the geometries of the contacts is advantageous.

A meandering length compensation section is to be understood as meaning that the length compensation section has at least one protrusion. In this case, the entry direction into the length compensation section can be the same as the exit direction from the length compensation section. Alternatively, the length compensation section can also be integrated into one of the bends of the respective contact.

In another embodiment, the contact device can comprise an insulating element, which can be formed to receive the first contact and the second contact and which can comprise an electrically insulating material. In addition, the contact device can have an outer conductor, which can be formed to receive the insulating element.

The insulating element serves to receive and mechanically fix the contacts. The contacts are thus held in the correct position by the insulating element when they are in the insulating element.

Furthermore, the insulating element serves to electrically insulate the contacts. For this purpose, the insulating element can be made of a corresponding material. For example, the insulating element can be produced from a suitable plastic, for example in an injection molding process.

In one design, the insulating element can be mechanically formed such that it can be applied to a carrier, for example a carrier circuit board. In contrast, in one design, the insulating element can be supplemented by an outer conductor.

The outer conductor can form a type of housing for the insulating element. Furthermore, the outer conductor can be made of a conductive material. Consequently, the outer conductor can be electrically contacted, for example with ground, on the receiving device, i.e., for example a carrier circuit board. When coupled to a plug end, the outer conductor can furthermore be electrically connected to an electrical shield or sheathing of the respective plug and of the associated conductor. Thus, a continuous shielding of the entire electrical connection can be ensured.

In yet another embodiment, the geometry of the insulating element and, in the presence of the outer conductor, the geometry of the outer conductor can be formed such that the capacitances of the first contact and of the second contact are compensated at any position in the contact device.

In this embodiment, the capacitances along the first contact and the second contact may be adjusted by selecting the geometry of the insulating element and the outer conductor. The contact device or the conductor paths within the contact device may consequently be formed as impedance-guided conductor paths.

It is furthermore understood that a housing for the contact device can be arranged around the outer conductor, which housing receives the outer conductor and can serve, for example, to mechanically fix the contact device on a carrier circuit board.

Furthermore, both the housing and the outer conductor and/or the insulating element may have mechanical fixing elements for mechanically fixing a plug end in the contact device.

In one embodiment, the first coupling end and the second coupling end may be arranged in parallel to one another in a first plane. The first contact can have a first bend at a fourth predetermined angle out of the first plane at a first predetermined distance from the first coupling end. Furthermore, the second contact can have a bend at a fifth predetermined angle out of the first plane at a second predetermined distance from the second coupling end, wherein the second predetermined distance can be smaller than the first predetermined distance.

The first plane is defined by the directions of longitudinal extent of the first coupling end and of the second coupling end, both of which lie in the first plane. In one embodiment, the fourth and fifth predetermined angles may each be formed as a 90° or approximately 90° angle, i.e., for example, as an angle between 80° and 100° or an angle between 85° and 95°. If the coupling ends are fastened, for example, to a carrier circuit board, the first bend starting from the carrier circuit board lies above the second bend. Starting from the carrier circuit board, the first contact end thus also lies above the second contact end. It is understood that the fourth predetermined angle and the fifth predetermined angle may be identical. Alternatively, the fourth predetermined angle and the fifth predetermined angle may also deviate from one another.

It is understood that the radius of the bends can be adapted according to the requirements depending on the material, installation space and application. In particular, a kink can also be provided instead of a bend.

In a further embodiment, the first contact can have a third bend at a sixth predetermined angle in parallel to the first plane at a third predetermined distance from the first coupling end.

It is understood that the sixth angle of the third bend can be selected such that the bend points toward the second contact. In this case, the third angle can in particular be less than 90°.

The third bend displaces the part of the first contact protruding from the first plane in the direction of the part of the second contact protruding from the first plane. The horizontal distance between the first contact end and the second contact end relative to, for example, the carrier circuit board is consequently reduced.

It is understood that the first distance and the third distance may be the same. Alternatively, the first distance may be greater than or less than the third distance.

In yet another embodiment, the second contact can have a bend at a fourth predetermined distance from the second coupling end at a seventh predetermined angle in parallel to a second plane and in the direction of the first contact. Furthermore, the second contact can have a fifth bend at a fifth predetermined distance at an eighth predetermined angle in parallel to the second plane. The eighth angle can have the same magnitude as the seventh angle and point in the opposite direction, and the fifth distance can be greater than the fourth distance. The second plane can furthermore be arranged orthogonally to the first coupling end and/or the second coupling end.

The second plane is orthogonal to the coupling ends and is thus parallel to, for example, a carrier circuit board on which the contact device can be arranged. The fourth and the fifth bend together form a type of S-curve or S-bend. It is understood that the radii of the bends may be the same or different in size.

In particular, in one embodiment, the radii and the angles of the fourth and fifth bends may be selected such that the second contact end, starting from the carrier circuit board, lies vertically closer below or entirely below the first contact end. The contact ends consequently lie one above the other in a front view of the contact ends.

FIG. 1 shows a front view of a contact device 100. The contact device 100 can be placed on a circuit board, for example, in order to electrically connect it to the plug of a cable. The contact device 100 has a housing 103, in which an insulating element 101 and an outer conductor 102 are arranged. A first contact 104 and a second contact 110 are arranged in the insulating element 101. The first contact 104 has a first coupling end 105 and a first contact end 106. The second contact 110 has a second coupling end 111 and a second contact end 112.

FIG. 1 furthermore shows a center plane 113, which intersects the contact device 100 along its length in the vertical axis.

It can be seen in FIG. 1 that the contact ends 106, 112 of the contacts 104, 110 lie vertically one above the other. In the embodiment in FIG. 1, the contact ends 106, 112 lie on the center plane 113. With conventional sockets, the contact ends lie horizontally next to one another. Such sockets therefore require a larger installation space in width.

In order to be able to advantageously electrically contact the contacts 104, 110, for example on a carrier circuit board (see FIG. 2), the coupling ends 105, 111 of the contacts 104, 110 are arranged horizontally next to one another in the contact device 100, i.e., to the right and left of the center plane 113. This makes it possible to connect the coupling ends 105, 111 to a receiver module, for example, without providing a corresponding length compensation for the conductor tracks.

Although not apparent in FIG. 1, it is understood that the first contact 104 and the second contact 110 are formed such that they are of the same length. As explained in detail below, one of the contacts 104, 110 can provide a length compensation section for this purpose, if necessary.

Figure 2:
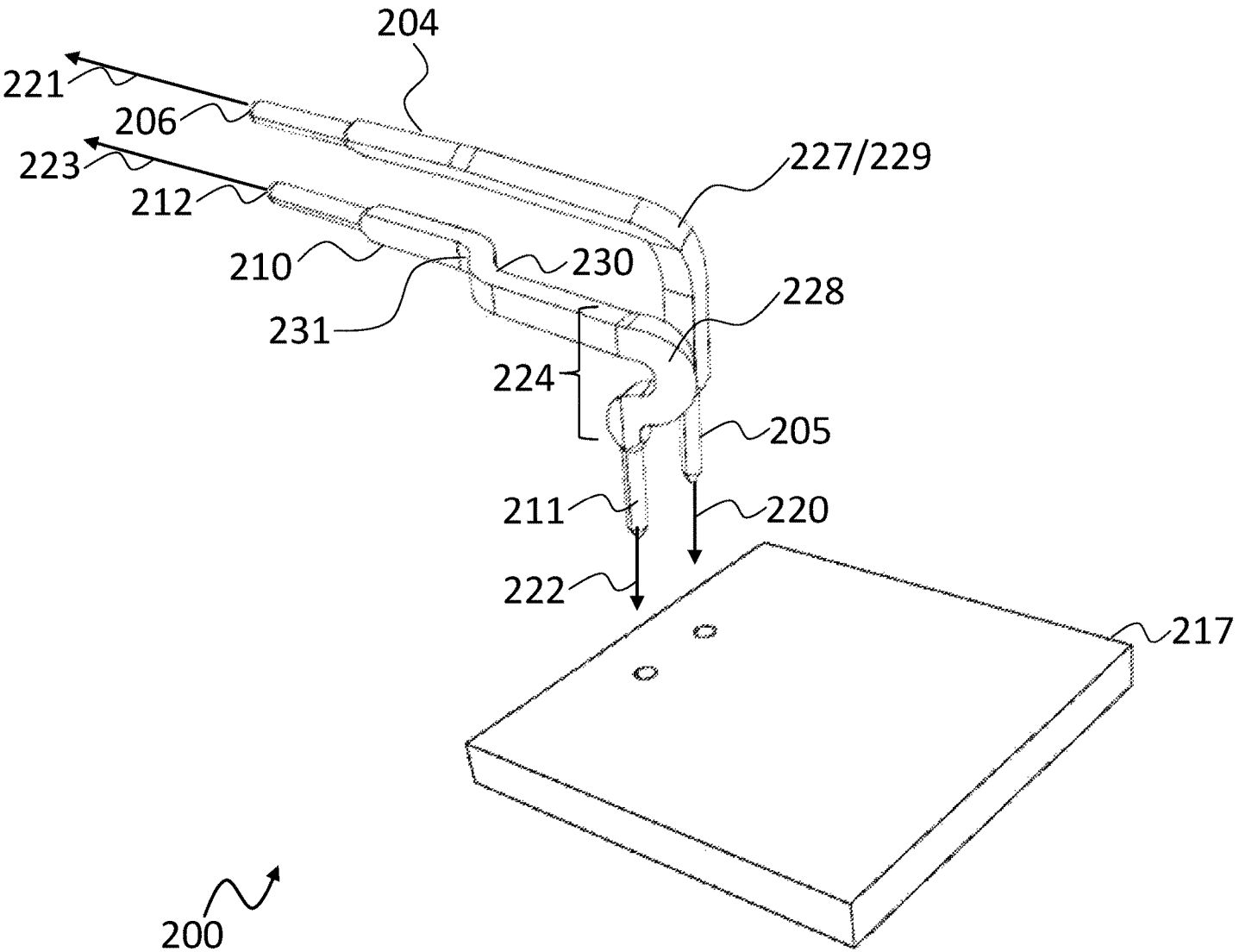
FIG. 2 a perspective view of an exemplary embodiment of a first contact and of a second contact according to the present invention.

FIG. 2 shows a perspective view of a first contact 204 and of a second contact 210 of a contact device 200. FIG. 2 shows a carrier circuit board 217 below the contacts 204, 210, into which carrier circuit board the first coupling end 205 and the second coupling end 211 may be inserted.

In addition to the first coupling end 205, the first contact 204 has a first contact end 206 at its other end. In addition to the second coupling end 211, the second contact end 210 has a second contact end 212 at its other end.

The first coupling end 205 and the second coupling end 211 are elongated and are perpendicular to the planar carrier circuit board 217. Consequently, the directions of longitudinal extent 220, 222 of the first coupling end 205 and of the second coupling end 211 are also perpendicular to the carrier circuit board 217.

The first contact end 206 and the second contact end 212 are also elongated. However, the first contact end 206 and the second contact end 212 each lie in a plane that is parallel to the plane of the carrier circuit board 217. In this case, the vertical distance between the first contact end 206 and the carrier circuit board 217 is greater than the vertical distance between the second contact end 212 and the carrier circuit board 217. As shown in FIG. 1, the first contact end 206 consequently lies above the second contact end 212.

In this case, the direction of longitudinal extent 220 of the first coupling end 205 is orthogonal to the direction of longitudinal extent 221 of the first contact end 206. Furthermore, the direction of longitudinal extent 222 of the second coupling end 211 is orthogonal to the direction of longitudinal extent 223 of the second contact end 212.

In order to be able to realize the positions and orientations described above for the coupling ends 205, 211 and the contact ends 206, 212, the first contact 204 and the second contact 210 each have a specific geometry, which have different bends.

For the sake of clarity, the distances and radii mentioned below are not provided separately with reference signs in FIG. 2. It is furthermore understood that the contacts 204, 210 shown in FIG. 2 are merely exemplary in nature. In other embodiments, both the mentioned distances and the mentioned radii may be adapted to the respective application. This applies analogously to the further figures.

The first contact 204 has a first bend 227 at a first predetermined distance from the first coupling end 205. The first bend 227 is parallel to a first plane through the direction of longitudinal extent 220 of the first coupling end 205 and the direction of longitudinal extent 222 of the second coupling end 211. With reference to FIG. 1, the contact end 206 is tilted or displaced toward the center plane by the first bend. The angle and the radius of the first bend 227 are selected such that the first contact end 206 is in its final position, i.e., with the third bend 229 described below, in a front view on a vertical plane between the first coupling end 205 and the second coupling end 211.

The second contact 210 has a second bend 228 at a second distance from the second coupling end 211. In contrast to the first bend 227, the second bend 228 is parallel to a second plane through the direction of longitudinal extent 221 of the first contact end 206 and the direction of longitudinal extent 223 of the second contact end 212. The second bend consequently tilts the second contact end 212 out of the first plane away from the carrier circuit board 217. Since the second contact end 212 is below the first contact end 206, the second distance is less than the first distance. It also applies to the second bend 228 that the angle and the radius are selected such that the second contact end 212 lies in its final position in a front view on the vertical plane between the first coupling end 205 and the second coupling end 211.

In the first contact 204, a third bend 229 is present at the position of the first bend 227. In this example, the claimed third distance is identical to the first distance. The second bend 229 tilts the first contact end 206 out of the first plane away from the carrier circuit board 217. The first bend 227 and the third bend 229 may also be regarded as a three-dimensional bend or a bend about a correspondingly oblique axis in space.

In order to position the second contact end 212 vertically below the first contact end 206, the second contact 210 has an S-shaped section with a fourth bend 230 and a fifth bend 231. The bends 230, 231 lie in a plane parallel to the carrier circuit board 217 and each have an angle with the same magnitude but opposite direction. The direction of longitudinal extent of the second contact 210 before the fourth bend 230 is therefore parallel to the direction of longitudinal extent of the second contact 210 after the fifth bend 231 and parallel to the direction of longitudinal extent 223 of the second contact end 212.

Finally, the second contact 210 has a length compensation section 224, which is combined with the second bend 228. The length compensation section is formed as a type of protrusion or 180° bend. The radius of this 180° bend is selected such that the protrusion produces the required length compensation. It is understood that instead of the protrusion shown, other geometries may likewise be used as length compensation. In the second contact 210, the second bend 228 and the length compensation section 224 are formed to be combined with one another. It is understood that a separate length compensation section is also possible.

The geometry of the first contact 204 and the geometry of the second contact 210 are selected such that the contacts 204, 210 have over their entire length a distance from one another that varies only by a predetermined threshold value. The distance is thus approximately constant or moves within a tolerable band. At the same time, both contacts 204, 210 have the same length.

In an exemplary design, the distance between the first contact 204 and the second contact 210 can be 2 mm. The predetermined threshold value can be, for example, 0.5 mm or 0.4 mm or 0.3 mm or 0.2 mm or 0.1 mm or 0 mm.

Figure 3:
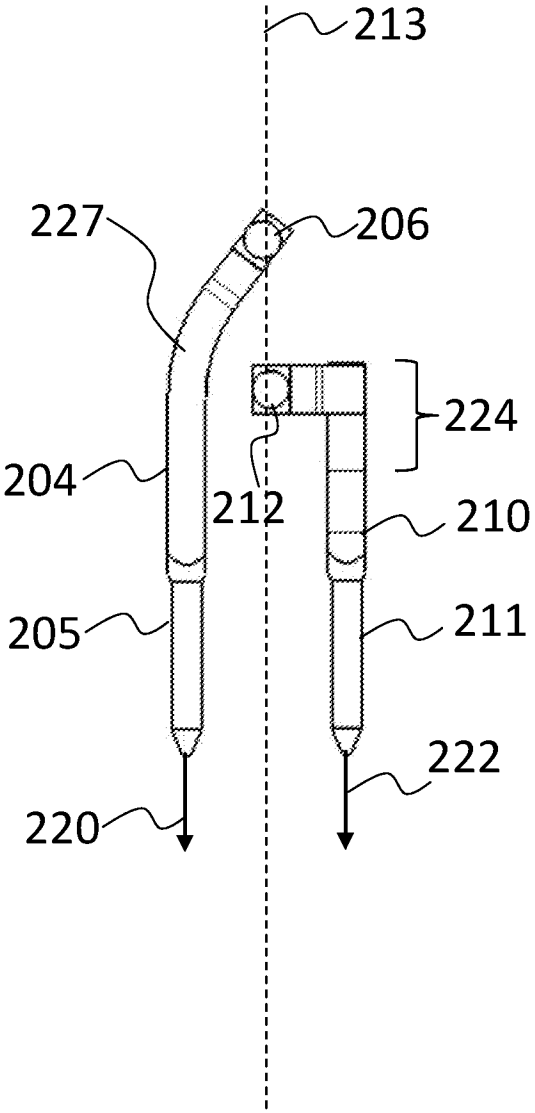
FIG. 3 a front view of an exemplary embodiment of a first contact and of a second contact according to the present invention.

FIG. 3 shows a front view of the first contact 204 and of the second contact 210. In the first contact 204, it can be seen that the first bend 227 is selected such that the first contact end 206 lies on the center plane 213. In the second contact 210, the bends cannot be seen since they are orthogonal to the plane of the representation. However, it can also be seen that the second contact end 212 also lies on center plane 213.

It can also be seen at the same time that the first coupling end 205 lies to the left of the center plane 213 and the second coupling end 211 lies to the right of the center plane 213.

Figure 4:
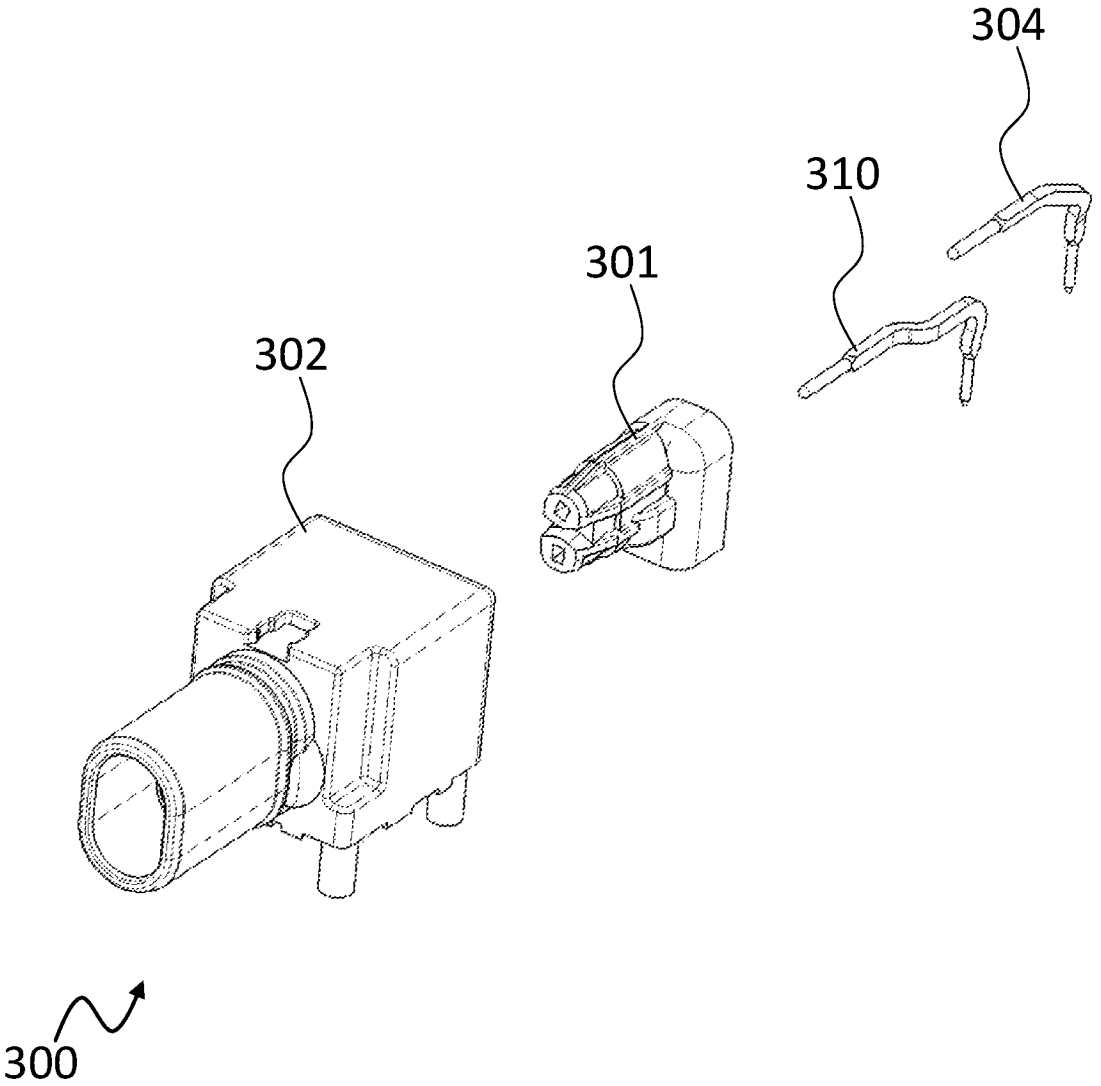
FIG. 4 an exploded view of an exemplary embodiment of a contact device according to the present invention.

FIG. 4 shows an exploded view of a contact device 300. The contact device 300 is shown without a corresponding housing and has an insulating element 301 that is arranged in an outer conductor 302. A first contact 304 and a second contact 310 are arranged in the insulating element 301.

The outer conductor 302 has an oval opening, whose axis of longitudinal extent lies vertically. The insulating element 301 is arranged in this opening. The insulating element 301 has a guide geometry for each of the contacts 304, 310 so that a contact end of the first contact 304 is guided vertically above the contact end of the second contact 310.

It can be seen in FIG. 3 that a socket with contacts horizontally next to one another would require an outer conductor with a horizontal axis of longitudinal extent. The largest extension of the oval would consequently lie in the horizontal. Such a socket would thus be significantly wider than the contact device according to the present invention.

The following FIGS. 5 to 8 each show further design options for a first contact and a second contact.

It is understood that the contact devices 100, 200 and 300 may be used with each design of a pair of first contact and second contact. In particular, in such embodiments, the outer conductor and the insulating element are adapted accordingly in order to receive the contacts with the corresponding geometries.

Figure 5:
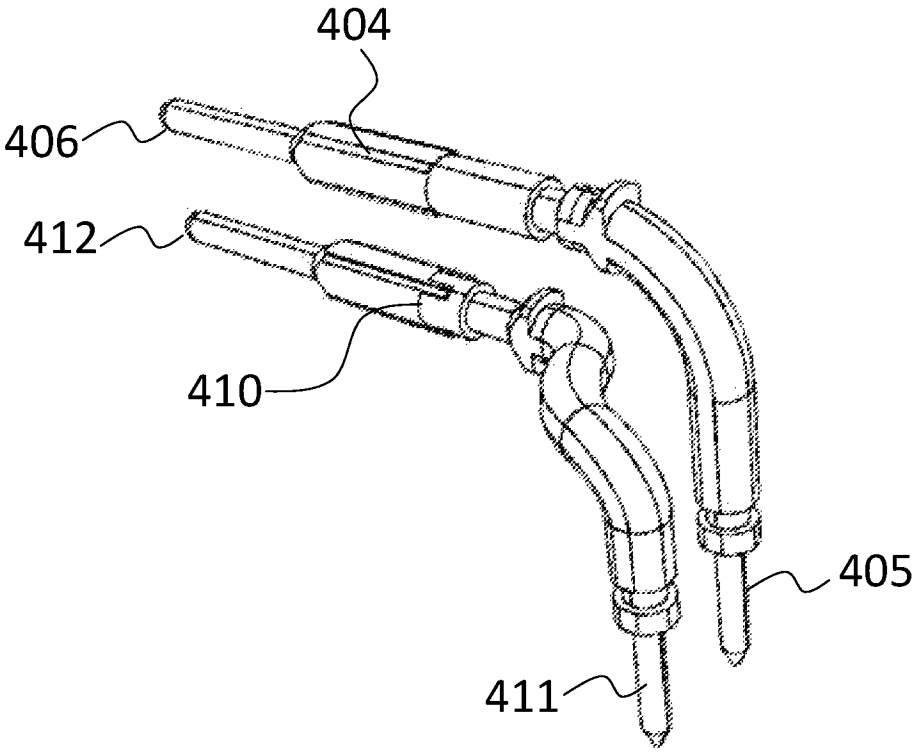
FIG. 5 a perspective view of a further exemplary embodiment of a first contact and of a second contact according to the present invention.

FIG. 5 shows a perspective view of a first contact 404 and of a second contact 410. The first contact 404 has a first coupling end 405 and a first contact end 406. The second contact 410 has a second coupling end 411 and a second contact end 412. The coupling ends 405, 411 and the contact ends 406, 412 are oriented like, for example, the coupling ends 205, 211 and the contact ends 206, 212 of FIGS. 2 and 3. However, the coupling ends 405, 411 are not situated symmetrically to the plane that is spanned by the contact ends 406, 412.

A first bend is not present in the first contact 404. This can also be understood to mean that the angle predetermined for the first bend is 0°. In such an embodiment, the first contact 404 lies in a plane that lies in the direction of longitudinal extent of the first coupling end 405 and the direction of longitudinal extent of the first contact end 406. In the first contact 404, the third bend described above has an angle of 90°.

Starting from the second coupling end 411, the second contact 410 has the second bend, which transitions into an S-shaped section, so that the second contact end 412 comes to lie under the first contact end 406 in the aforementioned plane.

In this embodiment, the coupling ends 405, 411 are not symmetrical to the plane through the contact ends 406, 412.

Figure 6:
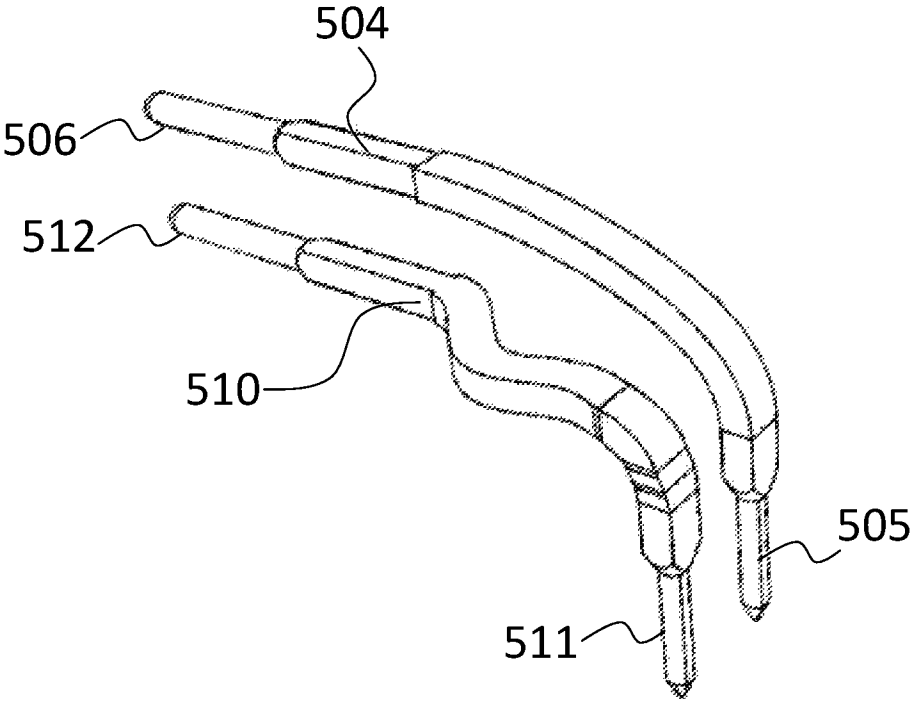
FIG. 6 a perspective view of a further exemplary embodiment of a first contact and of a second contact according to the present invention.

FIG. 6 shows a perspective view of a first contact 504 and of a second contact 510. The first contact 504 has a first coupling end 505 and a first contact end 506. The second contact 510 has a second coupling end 511 and a second contact end 512. The coupling ends 505, 511 and the contact ends 506, 512 are arranged like, for example, the coupling ends 205, 211 and the contact ends 206, 212 of FIGS. 2 and 3.

In the first contact 504, the aforementioned first bend and the aforementioned third bend were formed as a combined curved bend.

For positioning the second contact end 512, the second contact 510 has a single bend, which combines the aforementioned second bend and the aforementioned fourth bend. In the course of this bend, an S-loop is arranged as a length compensation. Subsequently, the fifth bend is provided so that the second contact end 512 is arranged in parallel below the first contact end 506.

Figure 7:
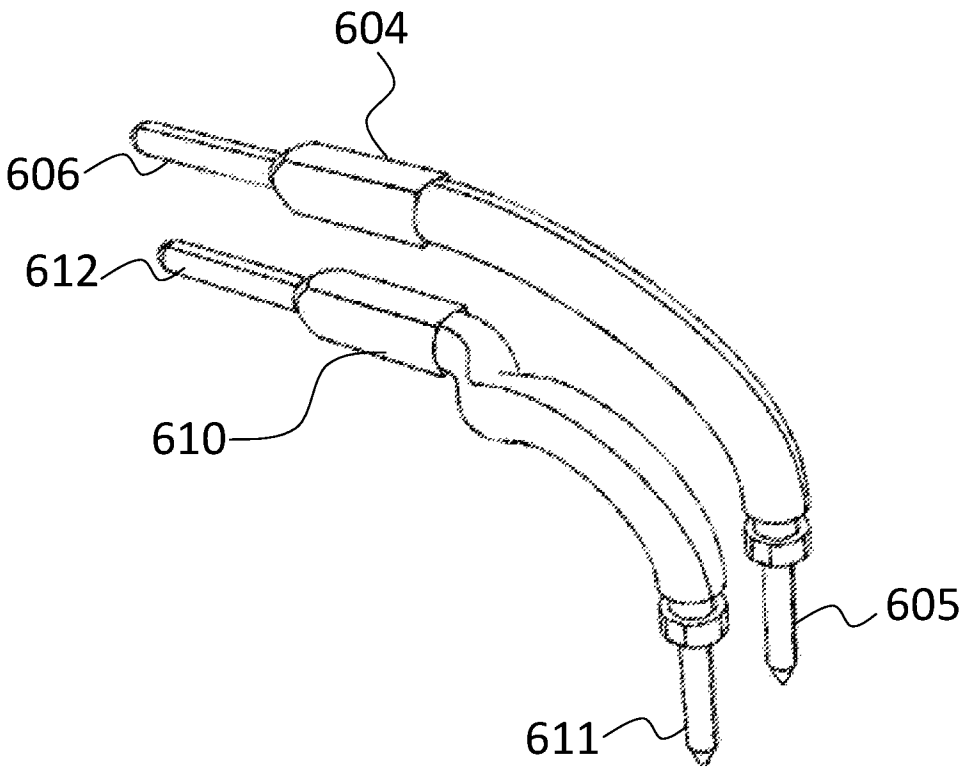
FIG. 7 a perspective view of a further exemplary embodiment of a first contact and of a second contact according to the present invention.

FIG. 7 shows a further perspective view of a first contact 604 and of a second contact 610. The first contact 604 has a first coupling end 605 and a first contact end 606. The second contact 610 has a second coupling end 611 and a second contact end 612. The coupling ends 605, 611 and the contact ends 606, 612 are arranged like, for example, the coupling ends 205, 211 and the contact ends 206, 212 of FIGS. 2 and 3.

The first contact 604 and the second contact 610 each have a curved bend so that the first coupling end 605 and the second coupling end 611 lie symmetrically next to a plane that is defined by the contact ends 606, 612 lying one above the other in parallel to one another. The second contact 610 can have an S-shaped length compensation section along the length of the curved bend, for example.

Figure 8:
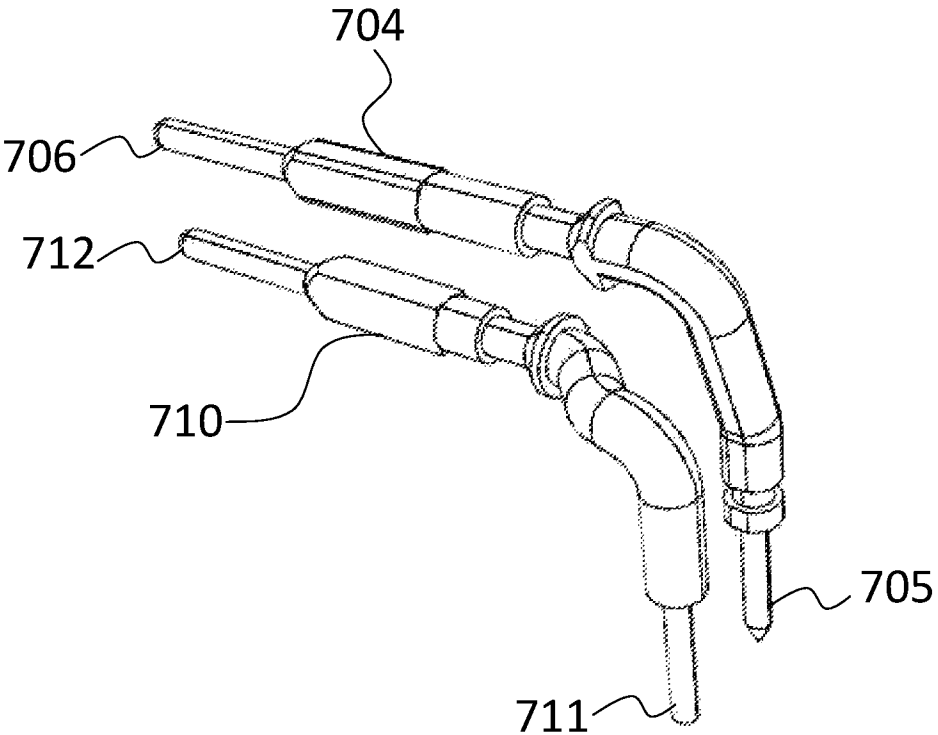
FIG. 8 a perspective view of a further exemplary embodiment of a first contact and of a second contact according to the present invention.

FIG. 8 shows a further perspective view of a first contact 704 and of a second contact 710. The first contact 704 has a first coupling end 705 and a first contact end 706. The second contact 710 has a second coupling end 711 and a second contact end 712. The coupling ends 705, 711 and the contact ends 706, 712 are arranged like, for example, the coupling ends 205, 211 and the contact ends 206, 212 of FIGS. 2 and 3.

The first contact 704 has the first bend at a distance from the first coupling end 705, which is less than the distance for the third bend. The first and third bends are consequently designed as separate bends.

The second contact 710 has both a second bend and the fourth and fifth bend, as already described above. It is understood that the lengths between the bends or the distances, which define the positions of the bends along the length of the second contact 710, are selected such that the second contact 710 is as long as the first contact 704 and the distance between the first contact 704 and the second contact 710 is within the predetermined range.

It is understood that the radii of the bends mentioned with respect to the figures may be selected accordingly depending on the application. In particular, the radii may be selected as a function of the diameter of the individual contacts. The radii may thus, for example, be a multiple or a fraction of the respective diameter, for example 1 to 5 times the diameter or 0.5 to 1 times the diameter. However, the radii may also be specified in absolute values. For example, the radii may be between 5 mm and 0 mm, in particular also between 2.5 mm and 0 mm, or 1 mm and 0 mm, in particular also between 0.5 mm and 0 mm, or between 0.25 mm and 0 mm or between 0.1 mm and 0 mm. Furthermore, the distances for the individual bends may be in the range from 0% to 100% of the total length of the respective contact. In particular, also in the range from 5% to 20%, or from 10% to 30%, or from 20% to 40%, or from 30% to 50%, or from 40% to 60%, or from 50% to 70%, or from 60% to 80%, or from 70% to 90%, or from 80% to 100%. In absolute values, the distances may be, for example, between 0 mm and 1 mm, or between 1 mm and 2 mm, or between 2 mm and 5 mm, or between 5 mm and 7 mm, or between 7 mm and 10 mm, or more.

Since the devices and methods described in detail above are exemplary embodiments, they may be modified in the usual manner to a wide extent by the person skilled in the art without departing from the scope of the invention. In particular, the mechanical arrangements and the proportions of the individual elements to one another are merely exemplary.

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

100, 200, 300 Contact device
101, 301 Insulating element
102, 302 Outer conductor
103 Housing
104, 204, 304, 404, 504, 604, 704 First contact
105, 205, 305, 405, 505, 605, 705 First coupling end
106, 206, 306, 406, 506, 606, 706 First contact end
110, 210, 310, 410, 510, 610, 710 Second contact
111, 211, 311, 411, 511, 611, 711 Second coupling end
112, 212, 312, 412, 512, 612, 712 Second contact end
113, 213 Plane
217 Receiving device
220 Direction of longitudinal extent of the first coupling end
221 Direction of longitudinal extent of the first contact end
222 Direction of longitudinal extent of the second coupling end
223 Direction of longitudinal extent of the second contact end
224 Length compensation section
227 First bend
228 Second bend
229 Third bend
230 Fourth bend
231 Fifth bend

What is claimed is:

1. A contact device for receiving a plug end, the contact device comprising:

a first contact, which has a first coupling end and a first contact end; and a second contact, which has a second coupling end and a second contact end;

wherein the coupling ends are configured to electrically couple the respective contact to a receiving device, and wherein the contact ends are configured to electrically connect the respective contact to a contact element of the plug end, wherein the shortest distance between the first coupling end and the first contact end is not equal to the shortest distance between the second coupling end and the second contact end, wherein the total length of the first contact is equal to, or is within a predetermined tolerance from, the total length of the second contact, and wherein the first coupling end and the second coupling end are arranged in parallel to one another in a first plane, wherein the first contact has a first bend at a fourth predetermined angle out of the first plane at a first predetermined distance from the first coupling end, wherein the second contact has a second bend at a fifth predetermined angle out of the first plane at a second predetermined distance from the second coupling end, wherein the second predetermined distance is smaller than the first predetermined distance, and wherein the first contact has a third bend at a sixth predetermined angle in parallel to the first plane at a third predetermined distance from the first coupling end.

2. The contact device according to claim 1, wherein the shortest distance between the first contact and the second contact varies at most by a predetermined limit value over the entire lengthwise extent of the contacts.

3. The contact device according to claim 1, wherein a direction of longitudinal extent of the first coupling end is parallel to a direction of longitudinal extent of the second coupling end, and wherein a direction of longitudinal extent of the first contact end is parallel to a direction of longitudinal extent of the second contact end.

4. The contact device according to claim 1, wherein the direction of longitudinal extent of the first coupling end is arranged at a first predetermined angle to the direction of longitudinal extent of the first contact end, and/or wherein the direction of longitudinal extent of the second coupling end is arranged at a second predetermined angle to the direction of longitudinal extent of the second contact end.

5. The contact device according to claim 4, wherein the first predetermined angle corresponds to the second predetermined angle.

6. The contact device according to claim 1, wherein a connecting line between the first coupling end and the second coupling end is arranged at a third predetermined angle of 60° to 120° or of 70° and 110° or of 80° to 100° or of 85° to 95° or an angle of 90°, to a plane that lies in the direction of longitudinal extent of the first contact end and the direction of longitudinal extent of the second contact end.

7. The contact device according to claim 1, wherein a connecting line between the first contact end and the second contact end is arranged at a predetermined angle of −30° to 30° or of −10° to 10° or of 0° to 5° or an angle of 0°, to the direction of longitudinal extent of the first coupling end or the direction of longitudinal extent of the second coupling end.

8. The contact device according to claim 1, wherein the first contact and/or the second contact between the first coupling end and the first contact end has a meandering length compensation section.

9. The contact device according to claim 1, further comprising:

an insulating element that is configured to receive the first contact and the second contact, the insulating element having an electrically insulating material, and an outer conductor that is configured to receive the insulating element.

10. The contact device according to claim 9, wherein the geometry of the insulating element and, in the presence of the outer conductor, the geometry of the insulating element is formed such that capacitances of the first contact and of the second contact are compensated at any position in the contact device.

11. The contact device according to claim 1, wherein the second contact at a fourth predetermined distance from the second coupling end has a fourth bend at a seventh predetermined angle in parallel to a second plane and in the direction of the first contact, and has a fifth bend at an eighth predetermined angle in parallel to the second plane at a fifth predetermined distance, in particular wherein the eighth angle has the same magnitude as the seventh angle and points in the opposite direction, and wherein the fifth distance is greater than the fourth distance, and wherein the second plane is arranged orthogonally to the first coupling end and/or the second coupling end.

12. The contact device according to claim 1, wherein the predetermined tolerance value is between 0 mm and 2 mm.

13. The contact device according to claim 12, wherein the predetermined tolerance value is between 0 and 0.05 mm.

14. A contact device for receiving a plug end, the contact device comprising:

a first contact, which has a first coupling end and a first contact end;

a second contact, which has a second coupling end and a second contact end;

an insulating element that is configured to receive the first contact and the second contact, the insulating element having an electrically insulating material; and an outer conductor that is configured to receive the insulating element, wherein the coupling ends are configured to electrically couple the respective contact to a receiving device, and wherein the contact ends are configured to electrically connect the respective contact to a contact element of the plug end, wherein the shortest distance between the first coupling end and the first contact end is not equal to the shortest distance between the second coupling end and the second contact end, wherein the total length of the first contact is equal to, or is within a predetermined tolerance from, the total length of the second contact, and wherein the geometry of the insulating element and, in the presence of the outer conductor, the geometry of the insulating element is formed such that capacitances of the first contact and of the second contact are compensated at any position in the contact device.

15. A contact device for receiving a plug end, the contact device comprising:

a first contact, which has a first coupling end and a first contact end; and a second contact, which has a second coupling end and a second contact end;

wherein the coupling ends are configured to electrically couple the respective contact to a receiving device, and wherein the contact ends are configured to electrically connect the respective contact to a contact element of the plug end, wherein the shortest distance between the first coupling end and the first contact end is not equal to the shortest distance between the second coupling end and the second contact end, and wherein the total length of the first contact is equal to, or is within a predetermined tolerance from, the total length of the second contact, wherein the predetermined tolerance value is between 0 mm and 2 mm.

16. The contact device according to claim 15, wherein the predetermined tolerance value is between 0 and 0.05 mm.

* * * * *